US006039487A

United States Patent [19]

Kristiansen

[11] Patent Number: 6,039,487

[45] Date of Patent: Mar. 21, 2000

[54] DISPOSABLE DISPENSER OF SAMPLES OF COSMETIC PRODUCT

[76] Inventor: Gordon Kristiansen, 135 Manor Hill Rd., Stratford, Conn. 06497

[21] Appl. No.: 08/984,634

[22] Filed: Dec. 3, 1997

Related U.S. Application Data

[63] Continuation-in-part of application No. 08/724,893, Oct. 3, 1996.

[51] Int. Cl.[7] ..... A46B 11/00

[52] U.S. Cl. ..... 401/126; 401/129

[58] Field of Search ..... 401/121, 122, 401/126, 129, 118

[56] References Cited

U.S. PATENT DOCUMENTS

| | | | |
|---|---|---|---|
| 3,693,758 | 9/1972 | Tierney | 401/129 X |
| 4,889,228 | 12/1989 | Gueret | 401/122 X |
| 4,952,204 | 8/1990 | Korteweg | 401/129 X |
| 5,826,600 | 10/1998 | Rowe et al. | 401/129 X |

*Primary Examiner*—David J. Walczak

[57] ABSTRACT

A dispenser employing an applicator having a product engaging device, a metal shaft secured at one end to the device and an elongated plastic rod secured at one end to the other end of the shaft. An elongated hollow plastic tube is sealed at one end and open at the other. An elongated hollow plastic container is sealed at one end and has an open opposite end designated as a neck. The open end of this tube is integrally secured to the neck. The container has a sample quantity of cosmetic product disposed therein. The applicator is disposed within the container and neck with the device engaging the sample and the rod extending within the tube.

3 Claims, 1 Drawing Sheet

18
16
20
24
22
14
12
10

18
16
14
20
16
23
22
23
12
10
22

16
22

DISPOSABLE DISPENSER OF SAMPLES OF COSMETIC PRODUCT

CROSS REFERENCE TO COPENDING APPLICATION

The present invention is a continuation-in-part of copending application Ser. No. 08/724,893, filed Oct. 3, 1996, entitled DISPOSABLE DISPENSER OF SAMPLES OF COSMETIC PRODUCT, in the name of Gordon Kristiansen.

BACKGROUND OF THE INVENTION

Disposable dispensers of samples of cosmetic products such as mascara, eye shadow, eye liner, and liquid or cream makeup are widely used to enable prospective users of such products to apply and test a small quantity to see whether such products should be purchased in larger quantities. For example, before a decision is made by a prospective user to use of any of these products, such user could apply a small amount in order to decide whether or not to purchase a larger quantity.

In known sample dispensers of mascara and the like, an applicator such as a brush is secured to a handle which in turn is secured to a threaded cap. A container of the cosmetic product has a small threaded neck. The applicator and handle is inserted through the neck into the container and the cap threadedly engages the neck. The container is provided with a separate internally disposed wiper component. When the cap is disengaged from the container to permit the applicator to be removed from the container, the component is engaged by the applicator while being withdrawn from the container in order to remove excess product before the user utilizes the applicator.

The present invention employs a new type of dispenser in which the threaded connection, cap and wiper component are all eliminated and a uniquely different construction is employed.

SUMMARY OF THE INVENTION

In accordance with the principles of this invention, a disposable dispenser of a product sample of mascara, eye shadow, eye liner, and liquid or cream makeup employs an elongated hollow plastic tube having a sealed outer end and an inner end permanently joined to the open neck of a hollow plastic container having a sealed opposite end. The container has a sample quantity of the product disposed therein.

A vertical applicator has product engaging means at a lower end, a short shaft secured at one end to the means and an elongated plastic rod secured at one end to the shaft. The applicator is inserted in the dispenser with the means engaging the sample and the rod extending through the hollow tube and friction fitted therein.

The region wherein the tube and neck of the container are joined is weakened so that the tube can be snapped away from the neck, permitting the tube and rod to be pulled out of the container to expose the product engaging means for use. The container incorporates an inner curved surface so positioned in the neck that the product engaging means when charged with product must be automatically and properly wiped by engagement with this surface as it is withdrawn from the container whereby all excess product is wiped off the product engaging means before the applicator is fully withdrawn from the container.

In the present invention, the handle, shaft and rod is inserted through the open bottom end of the container and the rod extends and is friction fitted within the tube. The container is then charged with the sample of cosmetic product and the bottom end of the container is sealed to complete the process.

DETAILED DESCRIPTION OF PREFERRED EMBODIMENTS

Figures 1, 2, 3, 4:
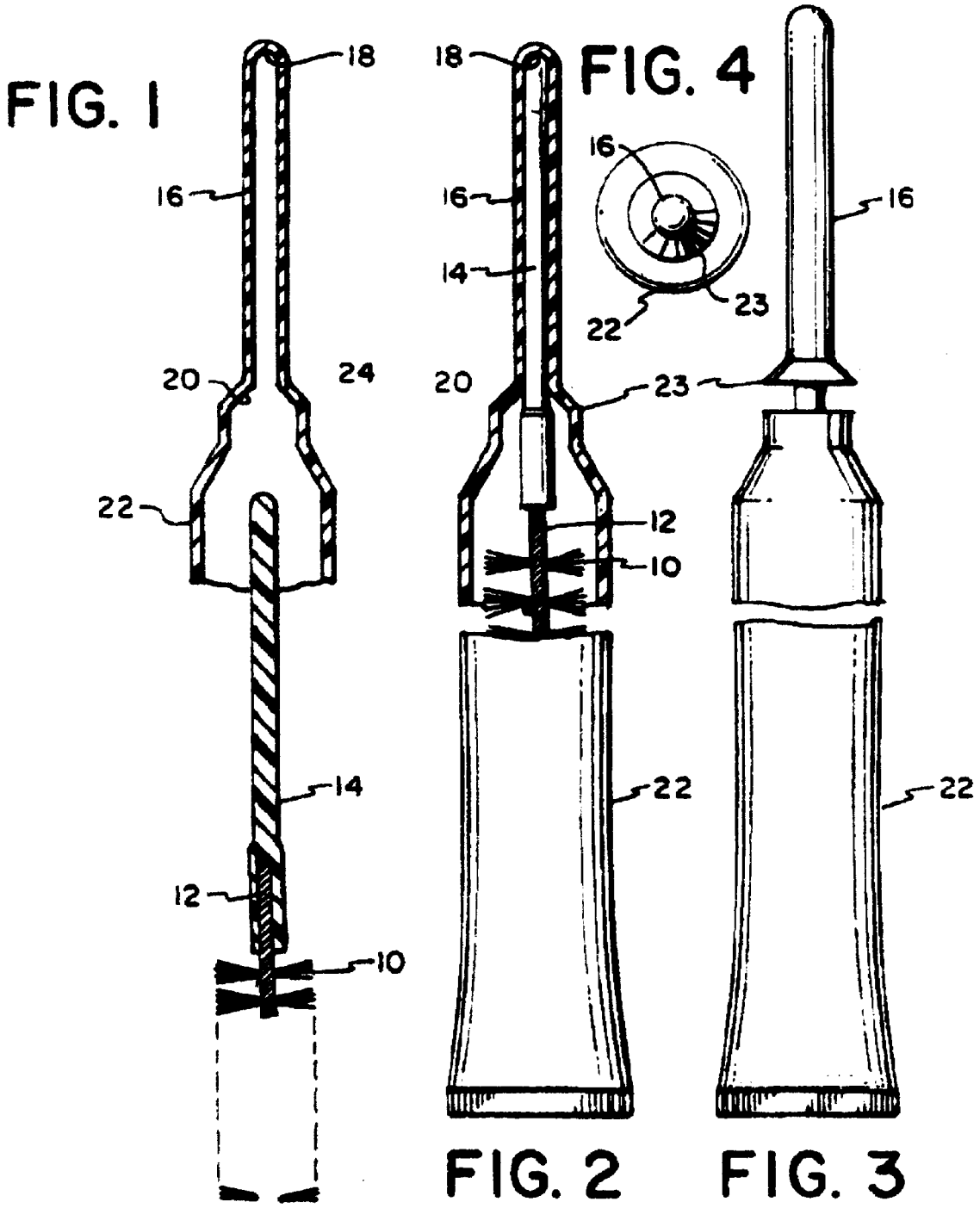
FIG. 1 is a partially cut away view illustrating the assembly process for constructing the applicator.
FIG. 2 is a partially cut away view illustrating the preferred embodiment partially assembled.
FIG. 3 is a side view of the completely assembled embodiment of FIG. 2.
FIG. 4 is a top view of the embodiment shown in FIG. 3.

Referring now to FIGS. 1–4, a disposable dispenser of a product sample of mascara, eye shadow, eye liner and liquid or cream makeup includes a vertical applicator which includes bristles 10, which form the product engaging means, at a lower end, secured at one end to a short metal shaft 12, the shaft in turn being secured to one end of a plastic rod 14. The product engaging means can be a brush, a sponge or other material as required.

An elongated hollow plastic tube 16 is closed at an outer end 18 and has an open opposite end integral with the open neck 20 of a hollow plastic container 22. The neck of the container incorporates an inner curved surface 24. The region wherein the tube and neck are joined has a weakened portion shown at 23.

In the present invention, in assembling the preferred embodiment, the bristles, shaft and rod are inserted through an open bottom end of the container so that the rod extends within the tube. The outer diameter of said rod, which has a circular cross section is very slightly smaller than the inner diameter of the tube which also has a circular cross section. Thus the rod is friction fitted within the tube. The container is then charged with the sample of cosmetic product and the bottom end of the container is sealed to complete the process.

Once the handle is snapped away from the container at portion 23, the rod remains connected to the shaft and bristles so that the engaging means can be withdrawn from the container while charged with product for use as indicated. The inner curved surface is so positioned in the neck that the bristles when charged with product will be automatically and properly wiped by engagement with this surface as it is withdrawn from the container whereby all excess product is wiped off the product engaging means before the applicator is fully withdrawn from the container.

While the invention has been described with particular reference to the drawings and preferred embodiments, the protection sought is to be limited only by the terms of the claims which follow.

What is claimed is:

1. A disposable dispenser of samples of cosmetic product comprising:

an applicator having product engaging means, a metal shaft secured at one end to said means, and an elongated plastic rod secured at one end to the other end of said shaft;

an elongated hollow plastic tube sealed at an outer end and open at an inner end, said rod extending within said tube;

an elongated hollow plastic container having a sample quantity of cosmetic product disposed therein, said container being sealed at one end and having an open opposite end designated as a neck, the inner end of the tube being joined to the neck, the region wherein the tube and neck are joined being deliberately weakened; the tube and container having a common direction of elongation;

whereby the tube can be snapped away from the container when separation pressure is applied at the weakened region while the rod remains connected via the shaft to said means, thus permitting the tube and rod to be pulled out of the container to expose the means for use.

2. The dispenser of claim 1 wherein the tube and rod have circular cross sections, the outer diameter of the rod being slightly smaller than the inner diameter of the tube so that the rod is friction fitted within said tube.

3. The dispenser of claim 2 wherein said neck has an inner surface which is engaged by the product engaging means upon withdrawal of the tube and rod from the container whereby the product engaging means is wiped to remove excess product before the means is withdrawn from the container.

* * * * *